US006068228A

United States Patent [19]

Kobayashi et al.

[11] Patent Number: 6,068,228

[45] Date of Patent: May 30, 2000

[54] SHOVEL KEEPING MECHANISM IN ICE MAKING MACHINE WITH ICE STORAGE BIN

[75] Inventors: Minoru Kobayashi; Katsumi Moriyama; Shinji Miyazaki; Masaaki Kawasumi, all of Shimane-ken; Katsunobu Minari; Sumio Inoue, both of Izumo; Hiromitsu Takeda, Shimane-ken; Shigeo Matsubayashi, Shimane-ken; Tomoyuki Ishida, Shimane-ken, all of Japan

[73] Assignee: Hoshizaki Denki Kabushiki Kaisha, Toyoake, Japan

[21] Appl. No.: 09/154,591

[22] Filed: Sep. 17, 1998

[51] Int. Cl.[7] ..... A47F 5/00

[52] U.S. Cl. ..... 248/309.1; 248/298.1

[58] Field of Search ..... 248/309.1, 316.8, 248/682, 37.6, 37.3, 298.1; 62/344; 312/350, 330.1

[56] References Cited

U.S. PATENT DOCUMENTS 5,681,116 10/1997 Lin ..... 248/298.1 X
5,738,324 4/1998 Van Hount et al. ..... 248/309.1 X

FOREIGN PATENT DOCUMENTS 2-45739 12/1990 Japan .

*Primary Examiner*—Ramon O. Ramirez
*Attorney, Agent, or Firm*—Arent Fox Kintner Plotkin & Kahn, PLLC

[57] ABSTRACT

A shovel keeping mechanism in an ice making machine provided with an ice storage bin placed under an ice making mechanism to store ice cubes dropped therefrom. The shovel keeping mechanism is composed of a pair of parallel support rail portions provided on the bottom surface of a component member located at a lowermost portion of the ice making mechanism and extended in a fore-and-aft direction of the ice storage bin, and a shovel holder detachably assembled with the parallel support rail portions to retain an ice shovel inserted therein from the front of the ice storage bin.

3 Claims, 7 Drawing Sheets

SHOVEL KEEPING MECHANISM IN ICE MAKING MACHINE WITH ICE STORAGE BIN

BACKGROUND OF THE INVENTION

1. Field of the Invention

The present invention relates to a shovel keeping mechanism in an ice making machine, more particularly to a shovel keeping mechanism in an ice making machine provided with an ice storage bin placed under an ice making mechanism to store ice cubes dropped therefrom.

2. Description of the Prior Art

In Japanese Utility Model Publication No. 2(1990)-45739, there has been proposed a shovel keeping mechanism in an ice making machine, in which the shovel keeping mechanism is composed of a plurality of support rods assembled in the form of a parallelepiped cage and detachably mounted to a component member such as a drain plate or the bottom plate of a water tank located at a lowermost portion of the ice making mechanism to retain therein an ice shovel for scooping up ice cubes.

Although the shovel keeping mechanism has various advantages in use, it is desired to improve the detachability of the shovel holder in the form of the parallelepiped cage, and it is also desired that the ice shovel cart be put on an appropriate place such as a ceiling plate of the ice making machine in a sanitary condition.

SUMMARY OF THE INVENTION

It is, therefore, an object of the present invention to provide a shovel keeping mechanism in an ice storage bin wherein the requirements described above are satisfied.

According the present invention, the object is attained by providing a shovel keeping mechanism in an ice making machine provided with an ice storage bin placed under an ice making mechanism to store ice cubes dropped therefrom, which comprises a pair of parallel support rail portions provided on a bottom surface of a component member located at a lowermost portion of the ice making mechanism and extended in a fore-and-aft direction of the ice storage bin, and a shovel holder detachably assembled with the parallel support rail portions to retain an ice shovel inserted therein from the front of the ice storage bin.

In a practical embodiment of the present invention, the shovel holder is made of synthetic resin and formed with a bottom wall, a pair of parallel side walls and a rear end wall which are respectively formed with an aperture for dropping ice cubes therethrough. The shovel holder is also formed to be put on an appropriate place to retain the ice shovel inserted therein without causing any contact therewith.

BRIEF DESCRIPTION OF THE DRAWINGS

Other objects, features and advantages of the present invention will be more readily appreciated from the following detailed description of preferred embodiments thereof when taken together with the accompanying drawings, in which.

DESCRIPTION OF THE PREFERRED EMBODIMENT

Figure 1:
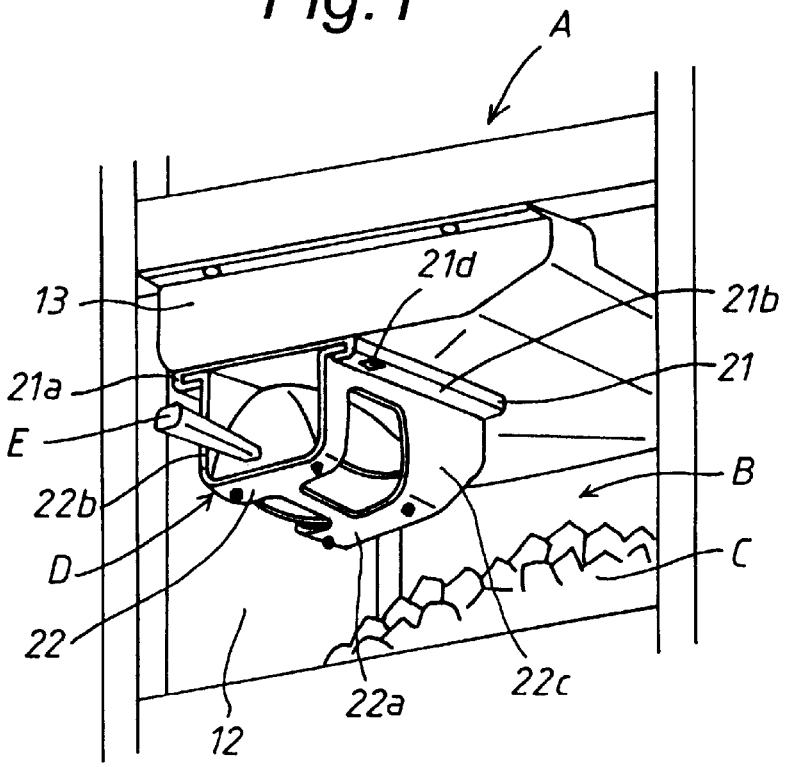
FIG. 1 is a perspective view of a shovel keeping mechanism in an ice making machine in accordance with the present invention.

Illustrated in FIG. 1 of the drawings is an ice making machine provided with an ice making mechanism A of the water jet type for automatically making ice cubes C and an ice storage bin B placed under the ice making mechanism A to store ice cubes C dropped therefrom. The ice storage bin B is provided at its front opening with a door 11 (shown in FIG. 8) to be opened and closed and is provided in its upper interior space with a shovel keeping mechanism D in accordance with the present invention.

Figure 2:
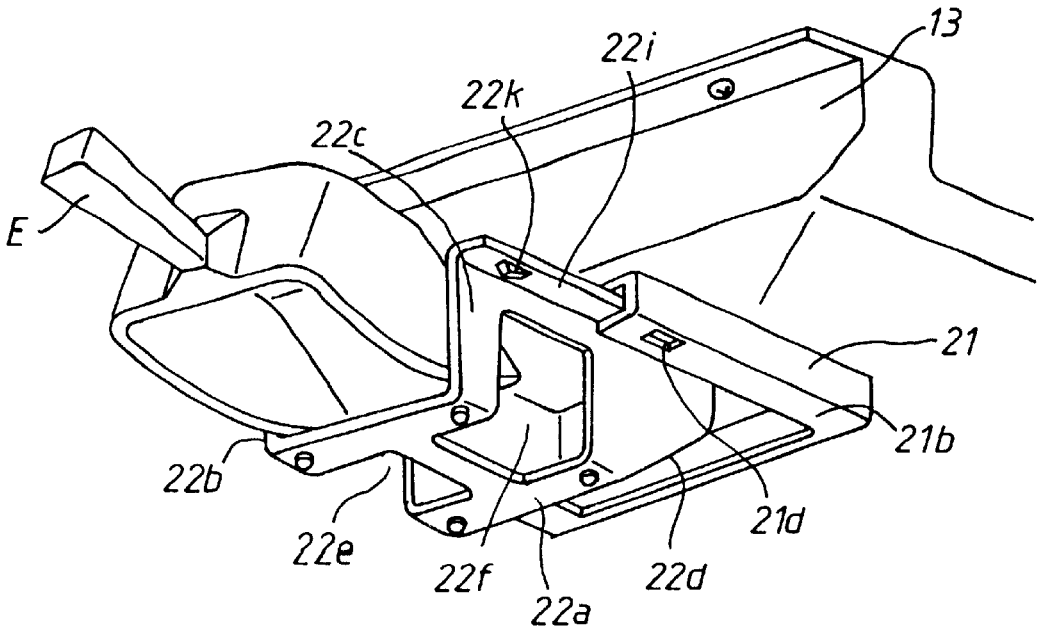
FIG. 2 is an enlarged perspective view of the shovel keeping mechanism in a condition where an ice shovel is drawn out of a shovel holder in the keeping mechanism and where the shovel holder is drawn out of its support bracket.
Figure 3:
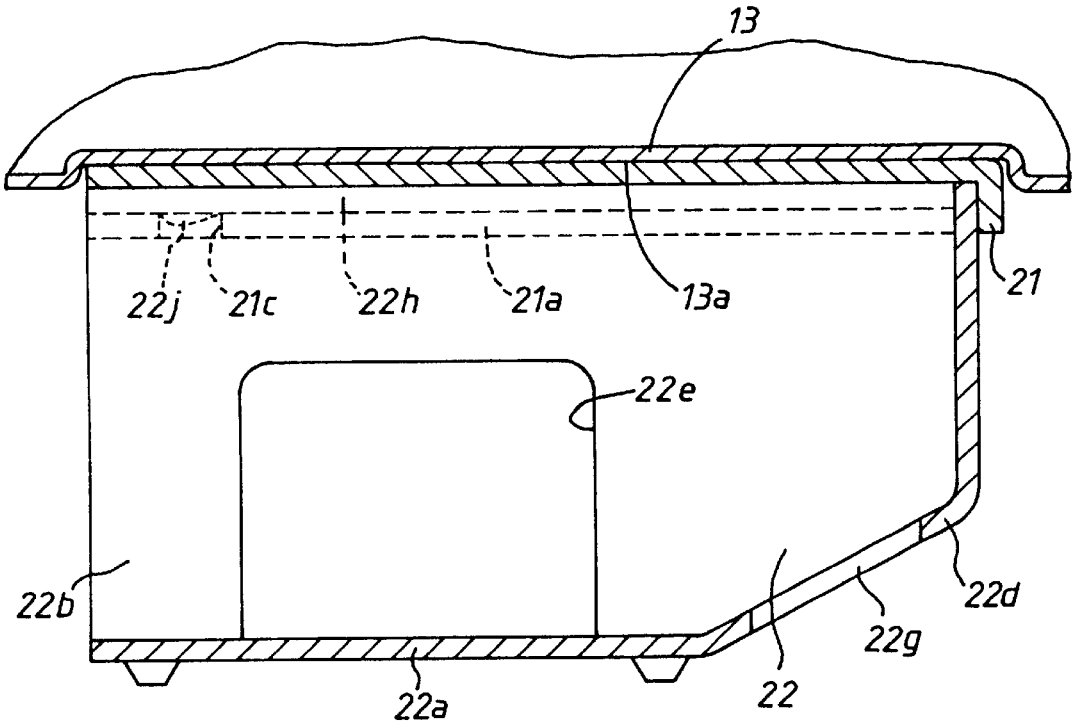
FIG. 3 is a sectional view of the shovel holder illustrated in relation to a support bracket mounted to the drain plate shown in FIG. 1.
Figure 6:
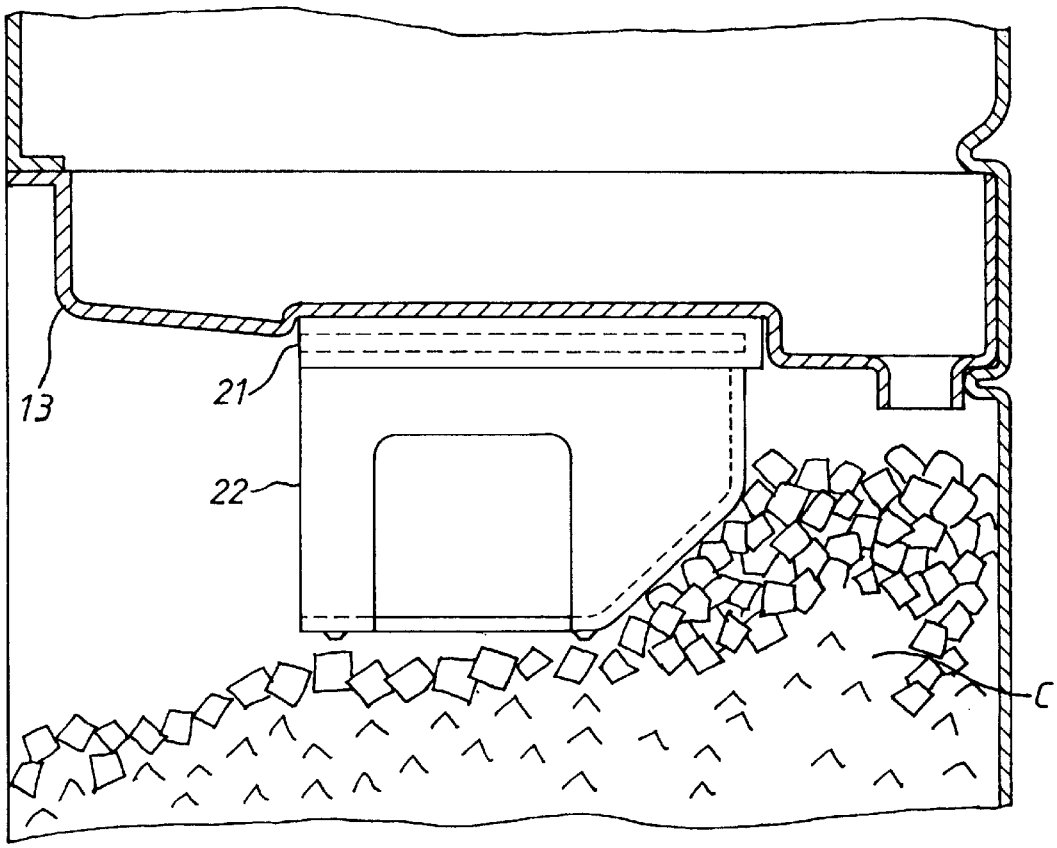
FIG. 6 is a sectional view of an ice storage bin placed under the ice making machine illustrating the shovel holder mounted to the drain plate.

As shown in FIGS. 1 to 3, the shovel keeping mechanism D is arranged to retain an ice shovel inserted therein from the front of the ice storage bin B. The shovel keeping mechanism D is composed of a support bracket 21 and a shovel holder 22. The support bracket 21 is made of synthetic resin and is adhered to a horizontal bottom surface 13*a* of a downward recess formed on a drain plate 13 located at a lowermost portion of the ice making mechanism A. As shown in FIGS. 1, 3 and 6, the support bracket 21 is formed with a pair of parallel rail portions 21*a*, 21*b* positioned by engagement with the bottom surface 13*a* of drain plate 13 and extended in a fore-and-aft direction of the ice storage bin B. The parallel rail portions 21*a*, 21*b* of support bracket 21 each are formed in a channel shape opened at its front end and closed at its rear end. The rail portions 21*a*, 21*b* are formed at their bottom walls with rectangular engagement holes 21*c*, 21*d*, respectively. As clearly shown in FIG. 6, the rail portions 21*a*, 21*b* of support bracket 21 are aligned with the bottom surface of drain plate 13 at their upper walls so that the shovel holder 22 is smoothly guided into the rail portions 21*a*, 21*b* of support bracket 21.

Figure 4:
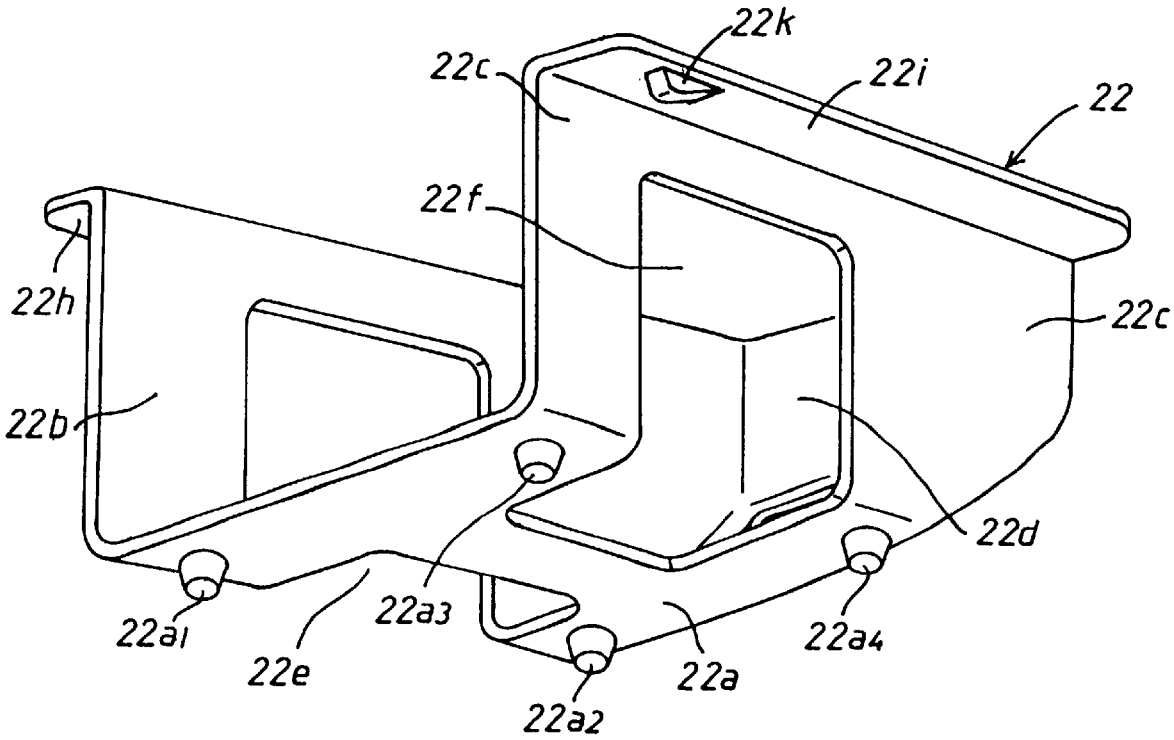
FIG. 4 is an enlarged perspective view of the shovel holder illustrating the bottom surface of the same.
Figure 5:
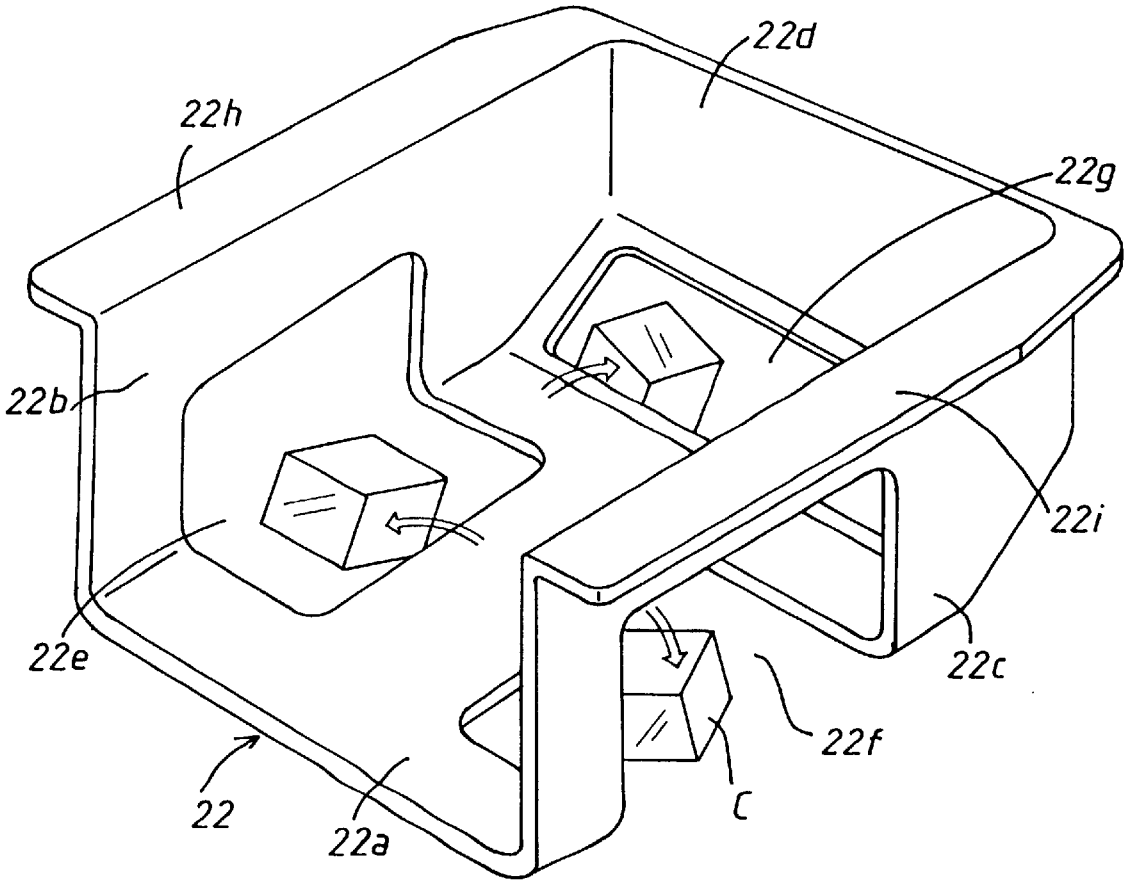
FIG. 5 is an enlarged perspective view of the shovel holder illustrating the interior of the same.

As clearly shown in FIG. 5, the shovel holder 22 is made of synthetic resin and is formed with a bottom wall 22*a*, a pair of parallel side walls 22*b*, 22*c* and a rear end wall 22*d* to retain the ice shovel E inserted therein from its front opening. The bottom wall 22*a*, side walls 22*b*, 22*c* and rear end wall 22*c* of shovel holder 22 are formed with apertures 22*e*, 22*f* and 22*g* respectively for dropping ice cubes therethrough. The side walls 22*b*, 22*c* of shovel holder 22 are integrally formed at their upper ends with horizontal flanges 22*h*, 22*i* which are telescopically inserted into the rail portions 21*a*, 21*b* of support bracket 21 for support of the shovel bolder 22. As shown in FIG. 4, the horizontal flanges 22*h*, 22*i* of shovel holder 22 are formed at their bottom surfaces with projections 22*j*, 22*k* which are engaged with the engagement holes 21, 21*d* of rail portions 121, 21*b* to retain the shovel holder 22 in place. The projections 22*j*, 22*k* of horizontal flanges 22*h*, 22*i* are formed to deform the lower walls of rail portions 21*a*, 21*b* downward when the horizontal flanges 22*h*, 22*i* of holder 22 are inserted into the rail portions 21*a*, 21*b* of support bracket 21.

Figure 7:
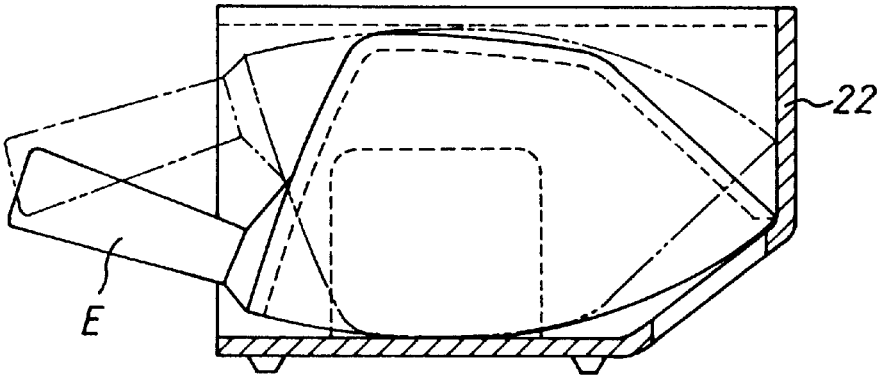
FIG. 7 is a sectional view illustrating the ice shovel retained in the shovel holder.
Figure 8:
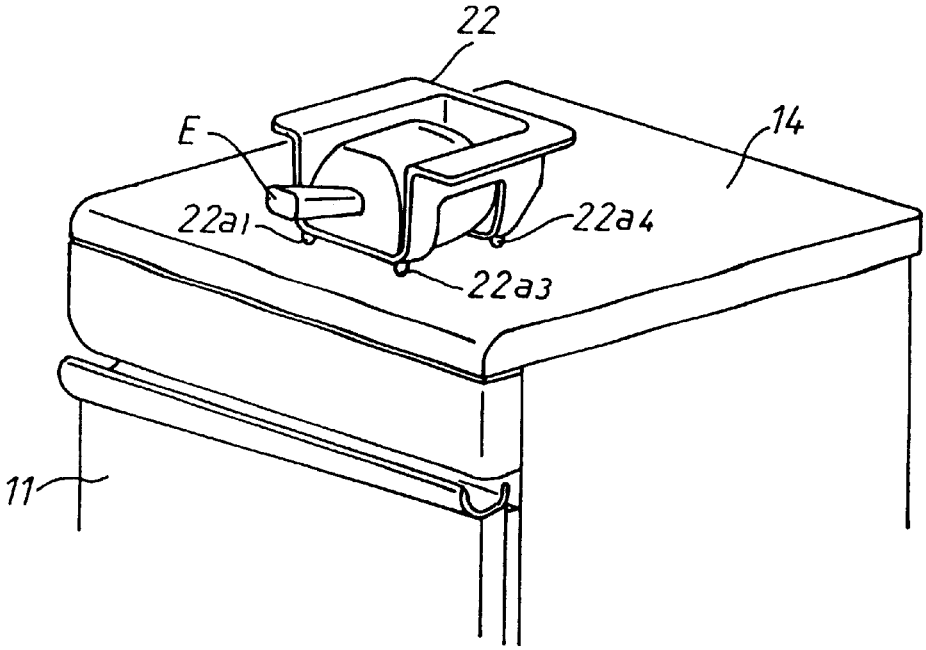
FIG. 8 is a perspective view illustrating the shovel holder put on a ceiling plate of the ice making machine.

The bottom wall 22*a* of shovel holder 22 is formed at its bottom surface with four projections 22*a*1–22*a*4 at each corner thereof which are utilized to support the shovel holder 22 put on a ceiling plate 14 of the ice making machine as shown in FIG. 8. In an actual practice of the embodiment, the projections 22*a*1–22*a*4 each may be provided with a sucker. As shown in FIG. 6, the rear end wall 22*d* of shovel holder 22 is inclined forward so that a storage space of ice cubes is formed under the shovel holder 22 and that the ice shovel E can be placed in reverse as shown in FIG. 7. The horizontal flanges 22*h*, 22*i* of holder 22 are tapered at their rear ends to be smoothly inserted into the rail portions 21, 21*b* of support bracket 21.

In use of the ice storage bin B described above, the shovel holder 22 can be telescopically carried by the rail portions 21*a*, 21*b* of support bracket 21 mounted to the bottom surface 13*a* of drain plate 13 at the lowermost portion of the ice making mechanism A. Thus, the shovel holder 22 can be easily removed from the support bracket 21 when it is drawn out to the front and can be easily carried by the support bracket 21 when it is pushed backward. Even if ice cubes C are brought into the shovel holder 22, the ice cubes drop into the storage bin B through the apertures 22*e*, 22*f*, 22*g* of holder 22 to facilitate putting in and out of the ice shovel E. When the ice shovel E is put into the holder 22, the rear end wall 22*d* of holder 22 acts as a stopper to place the ice shovel E in position within the holder 22. In a condition where the holder 22 has been put on the ceiling plate 14 of the ice making machine A as shown in FIG. 8, the ice shovel E can be put in the holder 22 without causing any contact with the ceiling plate 14. Thus, the ice shovel E can be used in a sanitary condition.

Figure 9:
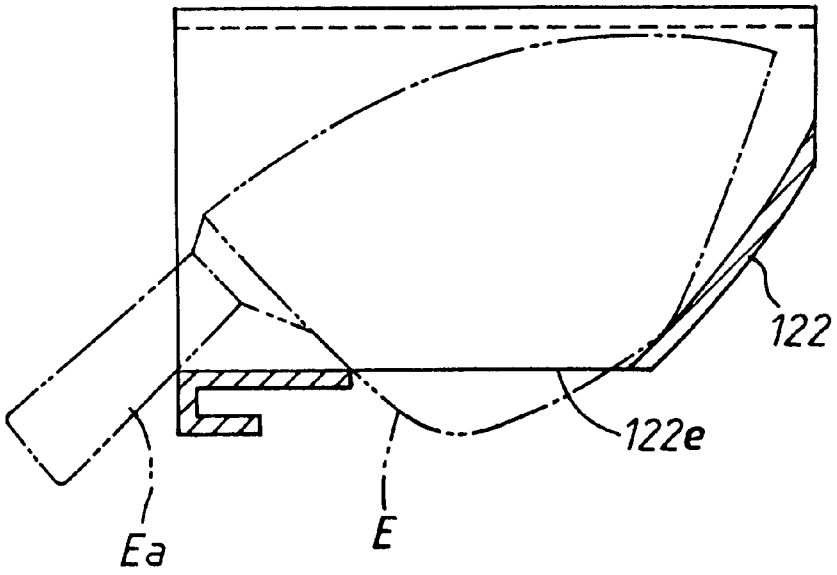
FIG. 9 is a sectional view of a modification of the shovel holder.
Figure 10:
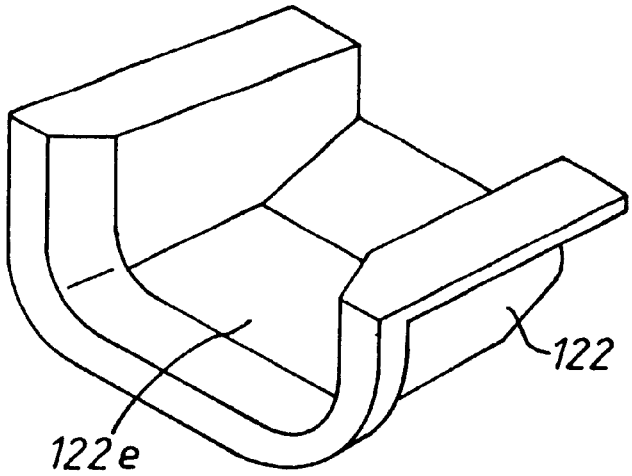
FIG. 10 is a perspective view of the modified shovel holder shown in FIG. 9.

Although in the foregoing embodiment, the ice shovel E is placed on the bottom wall 22*a* of holder 22 as shown in FIG. 7, the shovel holder 22 may be replaced with a holder 122 formed as shown in FIGS. 9 and 10, wherein the bottom of ice shovel E can be placed in an aperture 22*e* formed in the bottom wall 122*a* of holder 122 so that a sufficient space is. formed between the grip Ea of ice shovel E and the drain plate 13 to facilitate insertion of a user's hand. Although the rail portions 21*a*, 21*b* or bracket 21 in the foregoing embodiment has been mounted to the drain plate 13, the rail portions 21*a*, 21*b* may be integrally formed with the drain plate 13.

What is claimed is:

1. A shovel keeping mechanism in an ice making machine provided with an ice storage bin placed under an ice making mechanism to store ice cubes dropped therefrom, comprising:

a pair of parallel support rail portions provided on a bottom surface of a component member located at a lowermost portion of the ice making mechanism and extended in a fore-and-aft direction of the ice storage bin; and a shovel holder detachably assembled with the parallel support rail portions to retain an ice shovel inserted therein from the front of the ice storage bin;

wherein said shovel holder is made of synthetic resin and formed with a bottom wall, a pair of parallel side walls, and a rear end wall, the side walls of said shovel holder being integrally formed at their upper ends with horizontal flanges which are telescopically inserted into the parallel support rail portions and being formed at their bottom portions with apertures for dropping ice cubes therethrough, and the bottom wall of said shovel holder being formed with a support portion to be put on an appropriate place to retain the ice shovel inserted therein without causing any contact of the ice shovel with the place.

2. A shovel keeping mechanism as claimed in claim 1, wherein the support portion has a plurality of radially spaced projections formed on a bottom surface thereof to be put on the place to retain the ice shovel without causing any contact of the ice shovel with the place.

3. A shovel keeping mechanism in an ice making machine provided with an ice storage bin placed under an ice making mechanism to store ice cubes dropped therefrom, comprising:

a support bracket secured to a horizontal bottom surface of a downward recess formed on a drain plate located at a lowermost portion of the ice making mechanism, the support bracket being formed with a pair of parallel rail portions positioned by engagement with the horizontal bottom surface of said drain plate and extended in a fore-and-aft direction of the ice storage bin; and a shovel holder slidably carried by the parallel rail portions of said support bracket to retain an ice shovel inserted therein from the front of the ice storage bin;

wherein said shovel holder is made of synthetic resin and is integrally formed with a bottom wall, a pair of parallel side walls and a rear end wall, the side walls of said shovel holder being integrally formed at their upper ends with horizontal flanges which are telescopically inserted into the parallel support rail portions of said support bracket so that said shovel holder can be drawn out from the support bracket to the front, and the bottom wall of said shovel holder being formed with a support portion to be put on an appropriate place to retain the ice shovel thereon without causing any contact of the ice shovel with the place.

* * * * *